US009482470B2

(12) United States Patent
Shilling et al.

(10) Patent No.: US 9,482,470 B2
(45) Date of Patent: Nov. 1, 2016

(54) PROCESS AND METHOD FOR HOT CHANGING A VIM INDUCTION FURNACE

(75) Inventors: Jack Shilling, N. Canton, OH (US); Jeff Deeter, N. Canton, OH (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 470 days.

(21) Appl. No.: 14/126,451

(22) PCT Filed: Jun. 22, 2012

(86) PCT No.: PCT/US2012/043749

§ 371 (c)(1), (2), (4) Date: Dec. 16, 2013

(87) PCT Pub. No.: WO2013/003226

PCT Pub. Date: Jan. 3, 2013

(65) Prior Publication Data

US 2014/0112366 A1 Apr. 24, 2014

Related U.S. Application Data

(60) Provisional application No. 61/503,279, filed on Jun. 30, 2011.

(51) Int. Cl.

| | |
|---|---|
| ***H05B 6/06*** | (2006.01) |
| ***F27D 9/00*** | (2006.01) |
| ***F27B 17/00*** | (2006.01) |
| ***F27D 11/06*** | (2006.01) |
| ***F27B 14/06*** | (2006.01) |

(52) U.S. Cl.

CPC ..... *F27D 9/00* (2013.01); *F27B 14/061* (2013.01); *F27B 17/0016* (2013.01); *F27D 11/06* (2013.01); *F27D 2009/0002* (2013.01); *F27D 2009/0005* (2013.01)

(58) Field of Classification Search

CPC .. F27B 17/0016; F27B 14/061; F27D 11/06; F27D 9/00; H05B 6/24; H05B 6/26; H05B 6/02; H05B 6/42

USPC ..... 373/138, 141, 147, 148, 142, 143, 373/149–158, 47–49, 102–104

See application file for complete search history.

(56) References Cited

U.S. PATENT DOCUMENTS

| | | | | |
|---|---|---|---|---|
| 2,942,044 A | | 6/1960 | Lyman | |
| 5,125,004 A | | 6/1992 | Roberts et al. | |
| 5,271,033 A | * | 12/1993 | Bethge | F27B 14/04 373/138 |
| 5,974,077 A | * | 10/1999 | Abiko | C22B 9/003 373/140 |
| 6,287,513 B1 | | 9/2001 | Grady et al. | |

OTHER PUBLICATIONS

U.S. Searching Authority, International Search Report and Written Opinion, issued Oct. 23, 2012, for PCT/US2012/043749.

* cited by examiner

*Primary Examiner* — Hung D Nguyen
(74) *Attorney, Agent, or Firm* — Fay Sharpe LLP

(57) ABSTRACT

An apparatus, method and process directed to enabling a VIM induction furnace to be removed from a vacuum chamber while the induction furnace is still in a heated state without damaging the induction furnace. The induction furnace can include a power port that can be easily switched to an auxiliary cooling source to enable the induction furnace to be removed from the vacuum chamber while the induction furnace is still in a heated state.

10 Claims, 11 Drawing Sheets

PROCESS AND METHOD FOR HOT CHANGING A VIM INDUCTION FURNACE

The present invention claims priority on U.S. application Ser. No. 61/503,279 filed Jun. 30, 2011, which is incorporated herein by reference.

The present invention is directed to an induction furnace, and more particularly to an induction furnace that can be removed from a chamber while the induction furnace is still in a heated state and without damaging the induction furnace, and even more particularly to a VIM induction furnace having a power port that can be easily switched to an auxiliary cooling source to enable the induction furnace to be removed from the vacuum chamber while the induction furnace is still in a heated state and without damaging the induction furnace.

BACKGROUND OF THE INVENTION

A VIM induction furnace is a type of induction heating furnace that is operated in a vacuum chamber. The vacuum chamber is designed to enclose the entire induction furnace. Non-limiting examples of VIM induction furnaces are disclosed in U.S. Pat. No. 6,623,598; U.S. Pat. No. 6,360,810; U.S. Pat. No. 5,372,355; U.S. Pat. No. 4,557,757; US 2007/0022841; US 2002/0056538; EP 1118684; and EP 1114872, all of which are all fully incorporated herein by reference. Similar to all other types of industrial equipment, the induction furnace must be periodically serviced. Such service can include relining or other types of repairs to the induction system. Depending on the type of VIM induction furnace and the operational conditions of the VIM induction furnace, such service can occur quite often. The induction furnace generally cannot be serviced while inside the vacuum chamber. As such, the induction furnace typically must be removed from the vacuum chamber for servicing and another induction furnace is generally inserted into the vacuum chamber while the induction furnace that was recently removed is serviced. As such, one induction furnace is typically removed from the vacuum chamber and repaired while another induction furnace is typically inserted into the vacuum chamber and used to heat materials. This type of setup ensures that there is always a working induction furnace in the vacuum chamber, thereby reducing lost production time.

Although the switching of induction furnaces reduces lost production time, there is still significant lost time during the switch out process. The "hot" induction furnace must generally be allowed to cool down before removal from the vacuum chamber. While in service, the induction furnace has cooling water circulating through the induction coils. The flow of cooling water must be maintained until the induction furnace cools sufficiently or damage to the induction coils may result. This cool-down time results in a loss in production time. Depending on the size of the induction furnace and the temperatures reached during a heating process, the cool-down time for the induction furnace can be many hours or a number of days.

In view of the current state of the art of VIM induction furnaces, there remains a need to quickly switch out induction furnaces so as to reduce production losses traditionally encountered when waiting for an induction furnace to sufficiently cool prior to beginning the induction furnace change out.

SUMMARY OF THE INVENTION

The present invention is directed to an induction furnace that can be removed from a chamber while the induction furnace is still in a heated state and without damaging the induction furnace. More particularly, the present invention is directed to a Vacuum Induction Melting (VIM) furnace that can be removed from a vacuum chamber while the induction furnace is still in a heated state and without damaging the induction furnace. The present invention is still more particularly directed to a VIM induction furnace having a power port that can be easily switched to an auxiliary cooling source and the power leads can be easily disconnected to enable the induction furnace to be removed from the vacuum chamber while the induction furnace is still in a heated state and without damaging the induction furnace.

The present invention is directed to a product, method and process that allows an induction furnace to be removed while hot so that a spare furnace can be installed immediately without waiting for the hot furnace to cool down. Many VIM furnaces are cooled from an external source outside of the vacuum chamber through the power leads. These power leads generally pass through a power port located on the vacuum chamber. Special Joint Industry Council (JIC) fittings on the power leads are the actual electrical and cooling water interface. Breaking the JIC power lead connection breaks both the cooling water and electrical connection. The product, method and process of the present invention allows the water to be diverted around the JIC fittings for power connection of the power leads making it an electrical (dry) connection. JIC fittings, defined by the SAE J514 and MIL-F-18866 standards, are a type of flare fitting machined with a 37 flare seating surface. As can be appreciated, other types of fittings can be used. JIC fitting systems generally have three components that make a tubing assembly, namely a fitting, a flare nut, and a sleeve. As with other flared connection systems, the seal is achieved through metal-to-metal contact between the finished surface of the fitting nose and the inside diameter of the flared tubing. The JIC fitting can be formed of many different materials. Non-limiting materials include forged carbon steel, forged stainless steel, forged brass, machined brass, Monel and nickel-copper alloys.

There are at least two ways different arrangements that can be used to divert the water around the JIC power connection of the power leads so as to make the JIC power connection an electrical (dry) connection. As can be appreciated, other arrangement may exist to divert the water around the JIC power connection of the power leads so as to make the JIC power connection an electrical (dry) connection, and such other arrangements fall within the scope of the present invention.

In accordance with one non-limiting embodiment of the present invention, a water manifold is designed to be mounted to the power port and connected to the water manifold on the furnace body. The power port is designed to be removably connectable to the vacuum chamber and can be designed to be hung/hooked to the furnace body; however, this is not required. When the induction furnace is removed from the vacuum chamber, the power port and the internal power leads are all removed as a single unit.

In one specific non-limiting configuration of the invention, the induction furnace is cooled through the power leads during operation of the induction heating system. The cooling water or other type of cooling fluid flows through the external power leads and can be diverted around the JIC fitting through the power port and into the induction furnace. Generally, half of the leads are inlet water and half are return water; however, this is not required. When the furnace is to be changed, the vacuum chamber is opened. The water feed/cooling fluid and return lines are lowered into the chamber and attached to the manifold on the furnace body and the water/cooling fluid is turned on. Once the water/cooling fluid is turned on, the body manifolds and the power port manifolds can be deactivated. The hoses that divert the water/cooling fluid around the JIC dry power connections can be disconnected from the external water and then connected to the manifold on the power port. The only time the water/cooling fluid is not flowing through the induction coil is when a path is disconnected from the external water/cooling fluid and connected to the power port manifold. This is only a few seconds and will do no harm to the induction coil. The JIC fittings can now be disconnected. The power port can then be unbolted from the inside of the vacuum chamber flange and can be hung on the induction furnace. The induction furnace can then be removed to a location in the shop where it can continue cooling down. A new induction furnace can then be installed into the vacuum chamber.

In accordance with another specific non-limiting configuration of the invention, the induction furnace can be cooled through two water/cooling fluid paths through the vacuum chamber. The water/cooling fluid can be fed through the vacuum chamber wall to the inlet and outlet furnace body manifolds. The manifolds on the furnace body and the power port will be active throughout the entire heating cycles and the cool-down. The furnace side (male) of the JIC fittings will be cooled with internal water/cooling fluid through the power port manifolds. The external (female) side will be cooled from the external source through the leads. The external water/cooling fluid only cools the leads and the female JIC fitting. The water/cooling fluid is never diverted around the JIC fitting. When an induction furnace change is required, the vacuum chamber is opened. Water/cooling fluid feed and return lines are lowered into the vacuum chamber. The vacuum chamber water/cooling fluid lines are disconnected from the furnace body manifolds and the water/cooling fluid lines are lowered into the vacuum chamber are connected to the induction furnace body manifolds and the water/cooling fluid is turned on. The only time the coil is not being cooled is when the water/cooling fluid supply lines are being switched on the body manifolds. After the switch, the induction furnace is being cooled by the external water/cooling fluid lines that are lowered into the vacuum chamber. The JIC power leads can then be disconnected. The power port can then be unbolted from the inside of the vacuum chamber flange and hung onto the induction furnace. The induction furnace can now be removed to a location in the shop where it can continue cooling down. A new induction furnace can be installed into the vacuum chamber. The advantage of the second method is that all of the individual hoses that divert the cooling water/cooling fluid around the JIC fitting do not have to be connected/disconnected because the induction furnace cooling water/cooling fluid is never supplied through the power port. This can make an induction furnace change quicker.

In yet another non-limiting aspect of the present invention, the product, method and process that allows an induction furnace to be removed while hot so that a spare furnace can be installed immediately without the cool-down time is made possible because of a special fitting such as, but not limited to, a JIC fitting that allows the power to flow through it, but the cooling water/cooling fluid does not flow through the fitting. In one non-limiting arrangement, the JIC fitting has a baffle inserted into the fitting that diverts some of the water/cooling fluid to cool the internal surfaces at the end of the fitting. The end of the JIC fitting will heat the most because of the concentrated electric current flow. If the cooling water/cooling fluid flow in the fitting end is stagnant or the water/cooling fluid flow is insufficient, the cooling water/cooling fluid inside the power leads will boil. Such boiling will further compound the problem because the boiling water/cooling fluid will no longer make contact with the surfaces that will need to be cooled. Boiling in the fitting will also reduce the main water flow in the fitting. The design of the present invention is designed to overcome these potential problems during the change out of the induction furnace.

One non-limiting object of the present invention is a method and apparatus for easily changing out an induction furnace.

Another non-limiting object of the present invention is a method and apparatus for easily changing out an induction furnace from a vacuum chamber.

Still another non-limiting object of the present invention is a method and apparatus for easily changing out an induction furnace from a vacuum chamber prior to the induction furnace being cooled to a point wherein cooling fluid is not further required to be circulated in the induction furnace.

Yet another non-limiting object of the present invention is a method and apparatus that includes one or more JIC fittings to facilitate in the disengagement of the induction furnace from the primary power source and cooling fluid source.

Still yet another non-limiting object of the present invention is a method and apparatus that includes one or more JIC fittings which include one or more fluid baffles to maintain proper and desired cooling fluid flow through the one or more JIC fittings.

These and other objects and advantages will become apparent to those skilled in the art upon the reading and following of this description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein.

DESCRIPTION OF NON-LIMITING EMBODIMENTS OF THE INVENTION

Figure 1:
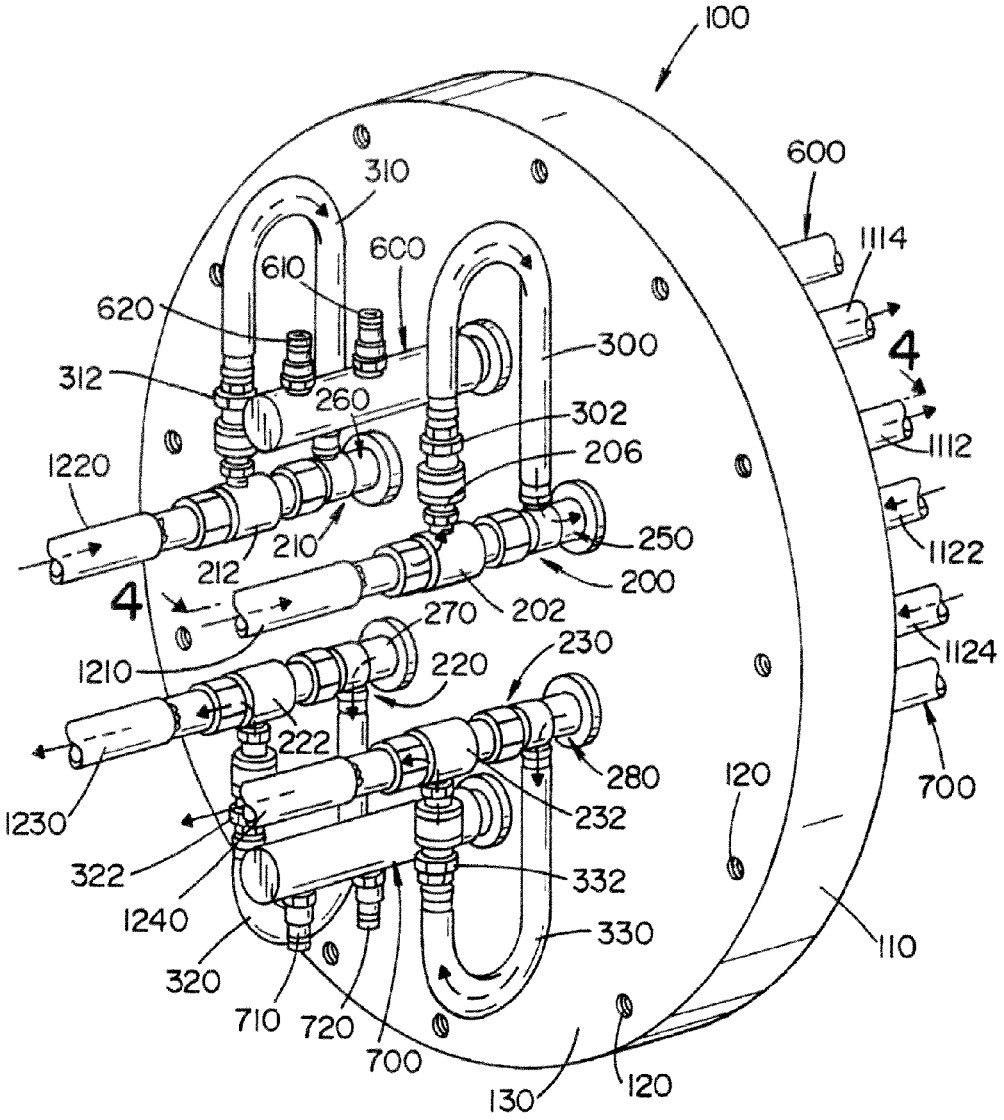
FIG. 1 illustrates the front face of a power port of a VIM induction furnace that includes the novel JIC fittings on the power leads and illustrates cooling fluid flowing through the power leads during the standard operation of the VIM induction furnace.

Referring now in greater detail to the drawings, wherein the showings are for the purpose of illustrating various embodiments of the invention only, and not for the purpose of limiting the invention, the present invention is directed to a method and apparatus to enable a VIM induction furnace to be removed from a vacuum chamber while the induction furnace is still in a heated state and without damaging the induction furnace. In particular, the invention is directed to a method and apparatus to enable a VIM induction furnace that has a power port which can be easily switched to an auxiliary cooling source to enable the induction furnace to be removed from the vacuum chamber while the induction furnace is still in a heated state and without damaging the induction furnace.

Many VIM furnaces are cooled from an external source outside of the vacuum chamber through the power leads. These leads pass through a power port located on the vacuum chamber. Special JIC fittings on the power leads are the actual electrical and cooling water interface. Breaking the JIC power lead connection breaks both the cooling water and electrical connection. The method and apparatus of the present invention to enable a VIM induction furnace to be removed from a vacuum chamber while the induction furnace is still in a heated state the water or cooling fluid to be diverted around the JIC power connection of the leads making it an electrical (dry) connection.

There are at least two ways to accomplish the objectives of the present invention. Both require that a water manifold be mounted to the power port and hosed to the water manifold on the furnace body. Also, both require the power port to be removed into the vacuum chamber and hung/hooked to the furnace body. When the furnace is removed, the power port and the internal power leads are all removed as a single unit.

The first method requires that the furnace be cooled through the power leads during operation. The cooling water/fluid goes through the external power leads and is diverted around the JIC fitting through the power port and into the furnace. Half of the leads are inlet water/fluid and half are return water/fluid. When the furnace has to be changed, the vacuum chamber is opened. Water/fluid feed and return lines are lowered into the chamber and attached to the manifold on the furnace body and the water/fluid is turned on. Such action makes the body manifolds active and the power port manifolds active. The hoses that divert the water/fluid around the JIC dry power connections are disconnected from the external water/fluid and then connected one at a time to the manifold on the power port. The only time water/fluid is not flowing through the induction coil is when a path is disconnected from the external water/fluid and then connected to the power port manifold. This lack of water/fluid is for only a few seconds and will do no harm to the coil. The JIC fittings can now be disconnected. The power port is then unbolted from the inside of the vacuum chamber flange and hung onto the furnace. The furnace can now be removed to a location in the shop where it can continue cooling down. A new furnace can be installed into the vacuum chamber.

The second method requires that the furnace be cooled through two water/fluid paths through the vacuum chamber. The water/fluid is fed through the vacuum chamber wall to the inlet and outlet furnace body manifolds. The manifolds on the furnace body and the power port will be active throughout the entire heating cycles and the cool-down. The furnace side (male) of the JIC will be cooled with internal water/fluid through the power port manifolds. The external (female) side will be cooled from the external source through the leads. The external water/fluid only cools the leads and the female JIC fitting. The water/fluid is never diverted around the JIC fitting. When a furnace change is required, the vacuum chamber is opened. Water/fluid feed and return lines are lowered into the chamber. The vacuum chamber water/fluid lines are disconnected from the furnace body manifolds and the water/fluid lines that are lowered into the chamber are connected to the furnace body manifolds and the water/fluid is turned on. The only time the coil is not being cooled is when the water/fluid supply lines are being switched on the body manifolds. After the switch, the furnace is being cooled by the external water/fluid lines lowered into the vacuum chamber. The JIC power leads can be disconnected. The power port is unbolted from the inside of the vacuum chamber flange and hung onto the furnace. The furnace can now be removed to a location in the shop where it can continue cooling down. A new furnace can be installed into the vacuum chamber.

The advantage of the second method is that all of the individual hoses that divert the cooling water/fluid around the JIC fitting do not have to be connected/disconnected because the furnace cooling water/fluid is never supplied through the power port. This will make a furnace change quicker.

The hot change method and apparatus of the present invention is made possible because of a special JIC fitting that allows the power to flow through it, but the cooling water/fluid flows around it. The fitting has a baffle inserted into the fitting that diverts some of the water/fluid to cool the internal surfaces at the end of the fitting.

Figure 4:
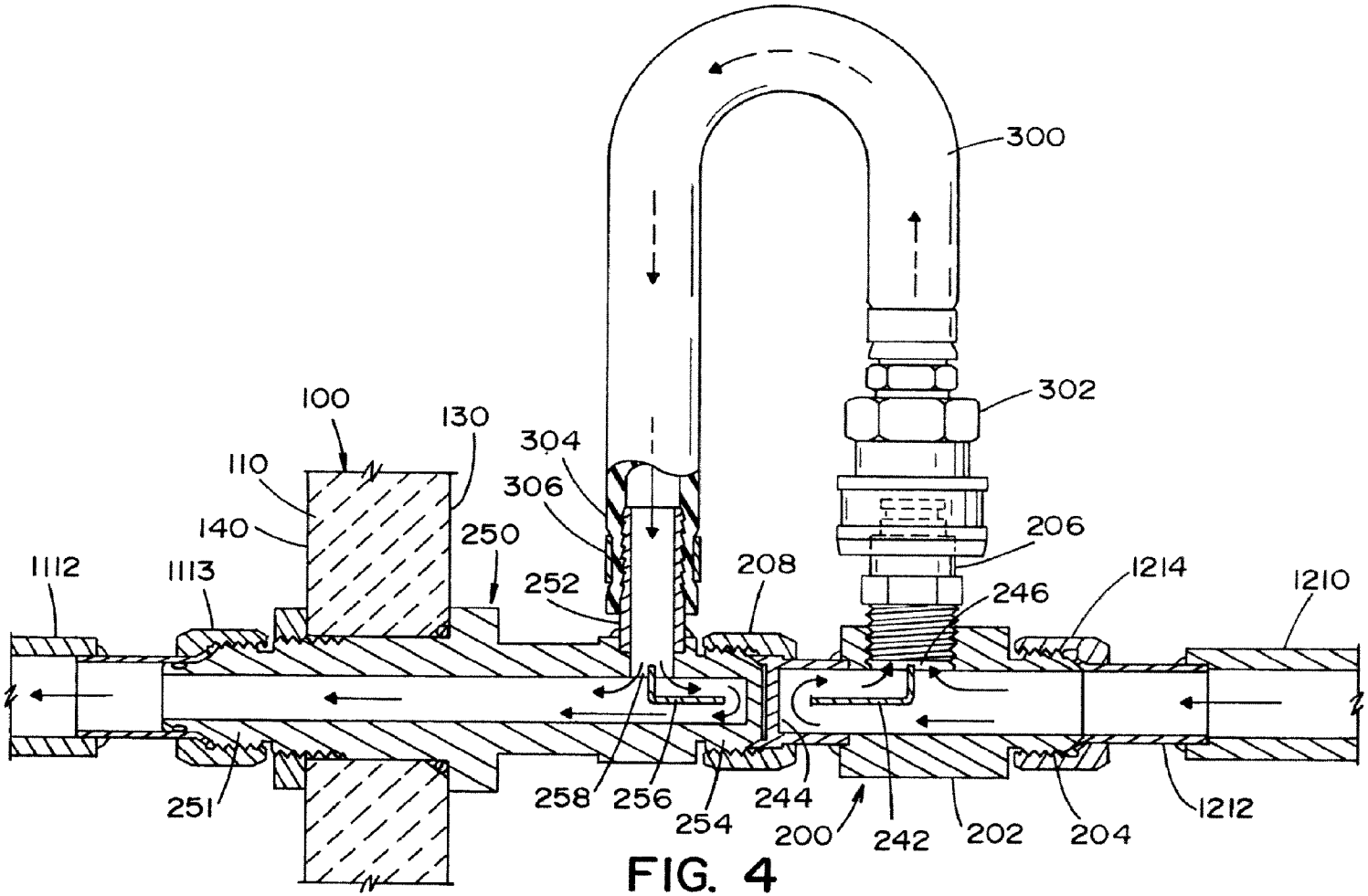
FIG. 4 is a cross-sectional view along lines 4-4 of FIG. 1.
Figure 5:
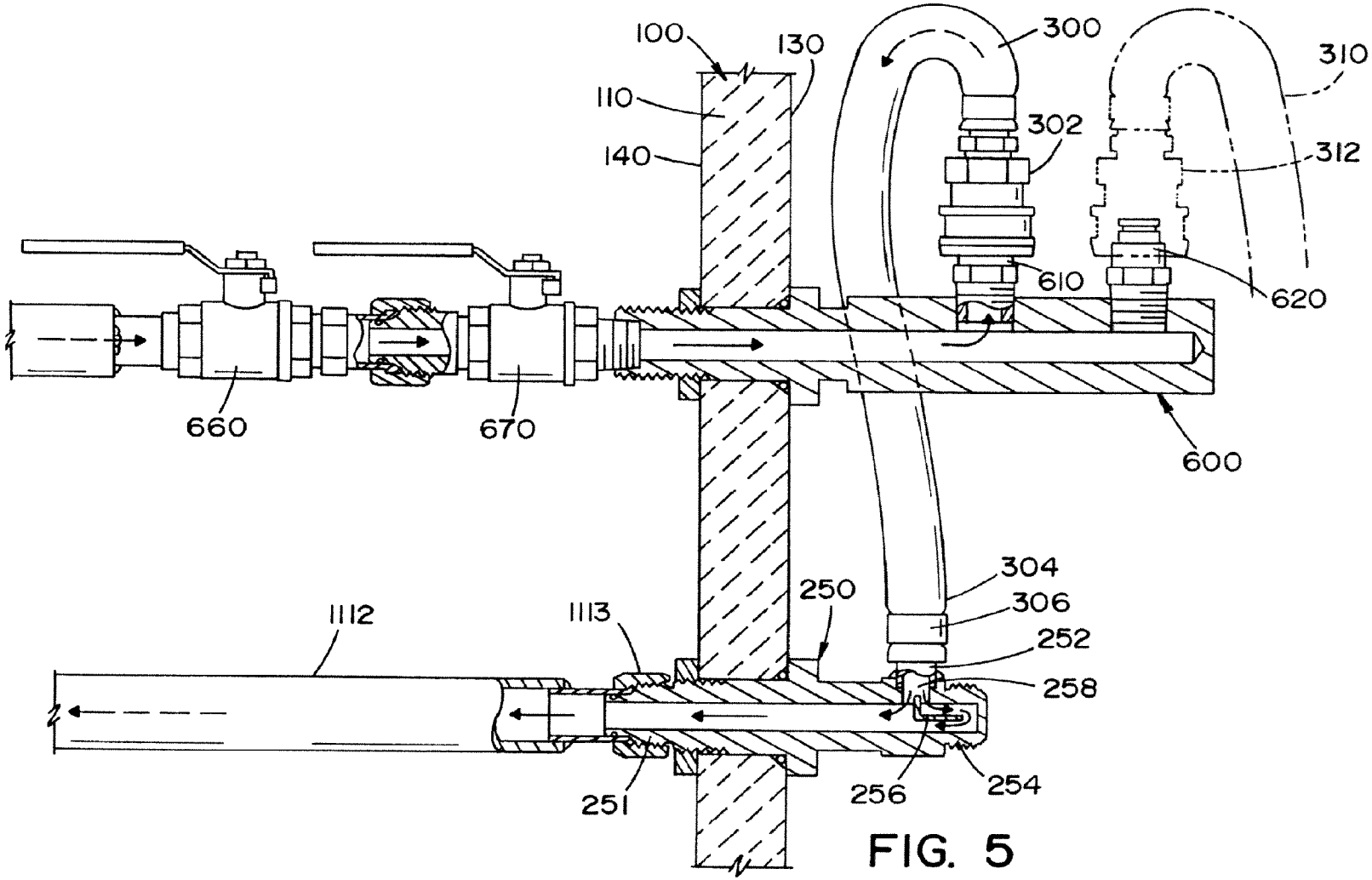
FIG. 5 is a partial cross-sectional view of FIG. 2.
Figure 6:
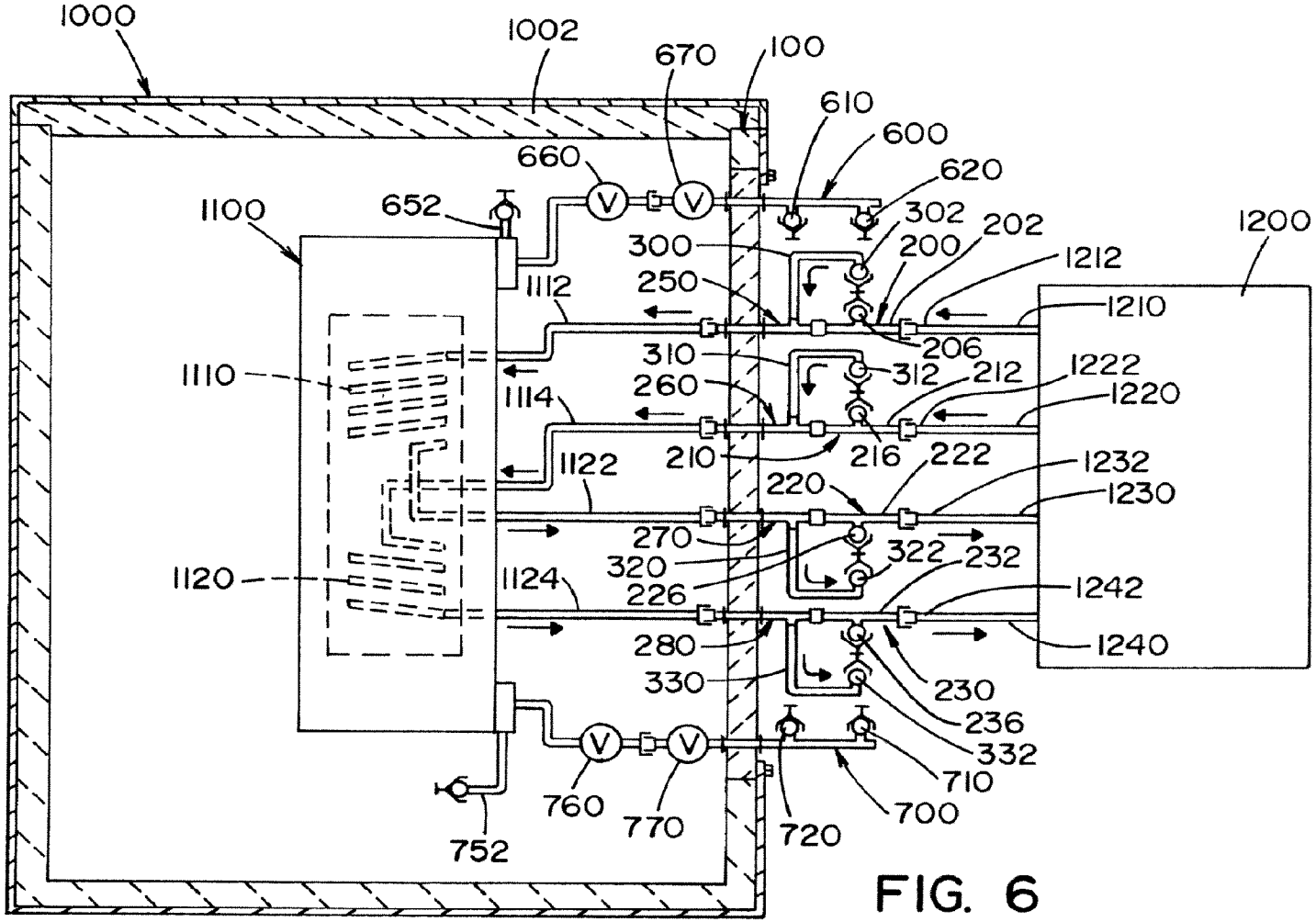
FIG. 6 is a schematic view of the power and cooling connections illustrating cooling fluid flowing through the power leads during the standard operation of the VIM induction furnace.
Figure 7:
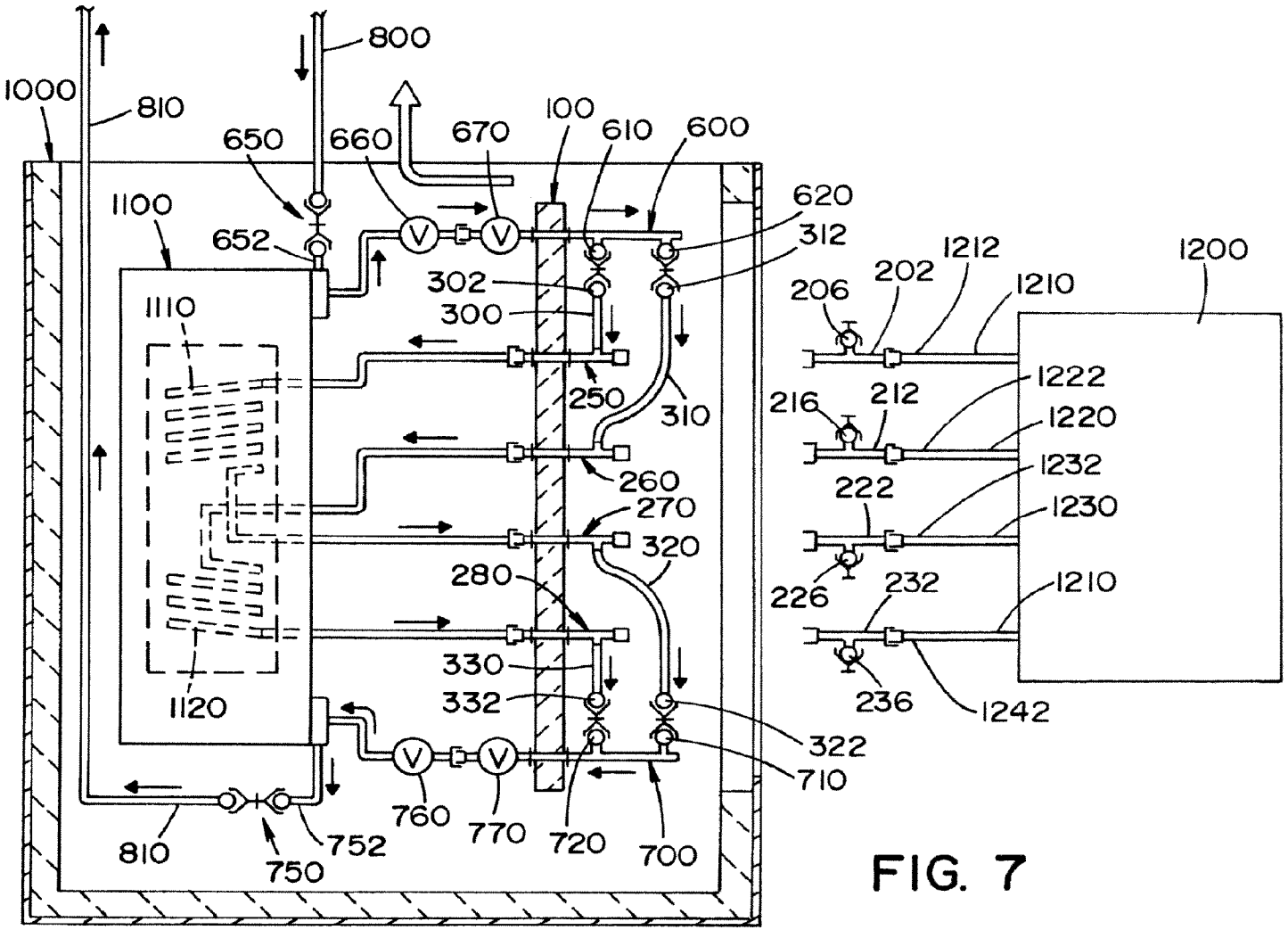
FIG. 7 is a schematic view of the power and cooling connections illustrating the power leads disconnected from the power source and the cooling fluid being connected to an auxiliary source for removal of the induction furnace from the vacuum chamber.

Referring now to FIGS. 1-7, wherein is illustrated one novel non-limiting embodiment of the present invention. FIG. 1 illustrates a power port 100 that can be removably connected to a vacuum chamber 1000 as illustrated in FIG. 7. FIG. 6 illustrates the power port connected to a portion of vacuum chamber 1000. The power port is designed to allow cooling fluid and power to be fed to the induction heating system 1100 as illustrated in FIG. 6. An external power source and cooling system 1200 is generally used to supply power and cooling fluid to the induction heating system. As illustrated in FIG. 6, the induction heating system is illustrated as including two induction coils 1110, 1120; however, it can be appreciated that the induction heating system can include only one induction coil or more than two induction coils. For purposes of describing this one non-limiting embodiment of the invention, the induction heating system will be described as including two induction coils.

The size, shape, configuration and materials of the vacuum chamber 1000 is non-limiting. Likewise, the size, shape, configuration and materials of the external power source and cooling system is non-limiting. Furthermore, the size, shape, configuration and materials of the induction heating system 1100 is non-limiting.

The power port 100 is illustrated as having a circular configuration; however, this is not required. The body 110 of the power port is generally formed of the same or similar material and has generally the same thickness as the walls of the vacuum chamber 1000; however, this is not required. Generally the body is formed of an insulative material; however, this is not required. The body can include one or more connectors or connection openings 120 or structures that can be used to secure the power port to the vacuum chamber 1000. The front face 130 of the power port includes four JIC power connectors 200, 210, 220, 230 and two auxiliary cooling fluid pipes 600, 700. The two auxiliary cooling fluid pipes 600, 700 are generally formed of a durable metal material; however, this is not required. The JIC power connectors are formed of a conductive and durable material such as, but not limited to, a conductive metal. When the power port is connected to the external power source and cooling system 1200 as illustrated in FIGS. 1, 4 and 6, the front portion 1212, 1222, 1232, 1242 of the power leads 1210, 1220, 1230, 1240 is connected to the front portion 202, 212, 222, 232 of the JIC power connectors 200, 210, 220, 230. The cooling fluid flow through the power leads and the JIC power connectors is illustrated by the arrow in FIGS. 1, 4, and 6.

Referring to FIG. 4, the power lead is formed of a conductive tubing (e.g., copper, aluminum, etc.) that enables current to flow through the power lead and to the JIC power connector. The tubing also enables cooling fluid to flow though the power lead to keep the power lead cool while current flows through the power lead. The end of the front portion of the power lead includes a coupler 1214. The coupler is illustrated as a threaded coupler; however, many other types of couplers can be used. The end of the front portion 202 of the JIC power connector includes a threaded region 204 that is designed to be connected/disconnect to/from coupler 1214.

As illustrated in FIG. 4, the cooling fluid flowing from the power lead and into the JIC power connector is split by a flow baffle 242. The flow baffle is designed to cause some of the cooling fluid to flow to the back region 244 of the front portion 202 of the JIC power connector so that the back region does not become over heated as current flows through the JIC power connector. The amount of cooling flow directed to the back region 244 can be controlled by the position of the flow baffle.

The cooling fluid exits the front portion 202 of the JIC power connector via opening 246. A quick coupling arrangement is illustrated as fluidly connecting the front portion 202 to a fluid cable 300. The fluid cable can be formed of any type of material. Generally the fluid cable is flexible; however, this is not required. As can be appreciated, other types of connectors can be used to releasably connect the fluid cable to front portion 202 of the JIC power connector. The quick coupling arrangement 206 is illustrated as including a flow valve to prevent fluid flow through opening 246 when the fluid cable is disconnected from the front portion 202 of the JIC power connector; however, this is not required. The front end 302 of the fluid cable 300 can also include a valve that prevents fluid flow through the end of the fluid cable when the end is disconnected; however, this is not required.

As illustrated in FIGS. 1, 4 and 6, the fluid cable 300, 310, 320, 330 is illustrated as directing cooling fluid from the front portion of the JIC power connector to the mid portion 250, 260, 270, 280 of the JIC power connector. The mid portion of the JIC power connector is designed to pass through body 110 of power port 100 as illustrated in FIG. 4. The mid portion of the JIC power connector includes a tube connector 252 used to connect the back end 304 of the fluid cable. A clamp 306 can be used to secure the fluid cable to the tube connector; however, this is not required. As can be appreciated, other types of connectors can be used (e.g., quick coupling arrangement, etc.).

Referring again to FIG. 4, the front end 254 of the mid portion 250 of the JIC power connector includes a threaded section that is designed to be secured to a threaded coupler 208 on the back end of the front portion 202 of the JIC power connector. As can be appreciated, other types of connection arrangements can be used to connect the mid portion 250 of the JIC power connector to the front portion 202 of the JIC power connector.

Figure 11:
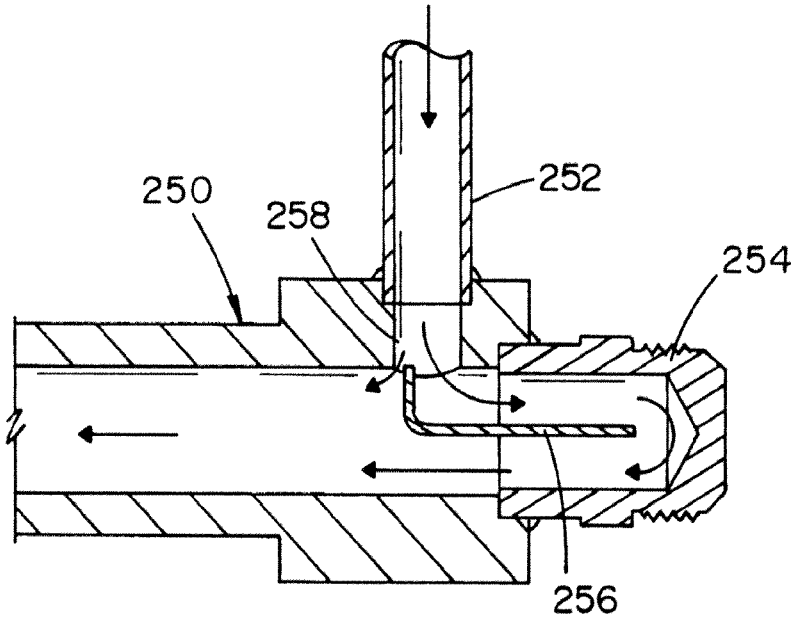

The front end 254 of the mid portion 250 of the JIC power connector also includes a flow baffle 256 that slits the flow of cooling fluid that flows into the mid portion 250 of the JIC power connector. The flow baffle directs a portion of the cooling fluid to the front of the mid portion 250 of the JIC power connector so as to prevent the front end of the mid portion 250 of the JIC power connector from becoming too hot when current flows through the mid portion 250 of the JIC power connector. The use of flow baffles 242 and 256 are optional. The amount of cooling fluid directed to the front end of the mid portion 250 of the JIC power connector can be controlled by the relative position of the flow baffle to opening 258 of the mid portion 250 of the JIC power connector. FIG. 11 illustrates the flow baffle positioned such that a majority of the cooling fluid is directed by the flow baffle to the front end of the mid portion 250 of the JIC power connector. As can be appreciated, the flow baffle can be positioned such that half or less than half of the cooling fluid flow is directed to the front end of the mid portion 250 of the JIC power connector.

Figure 3:
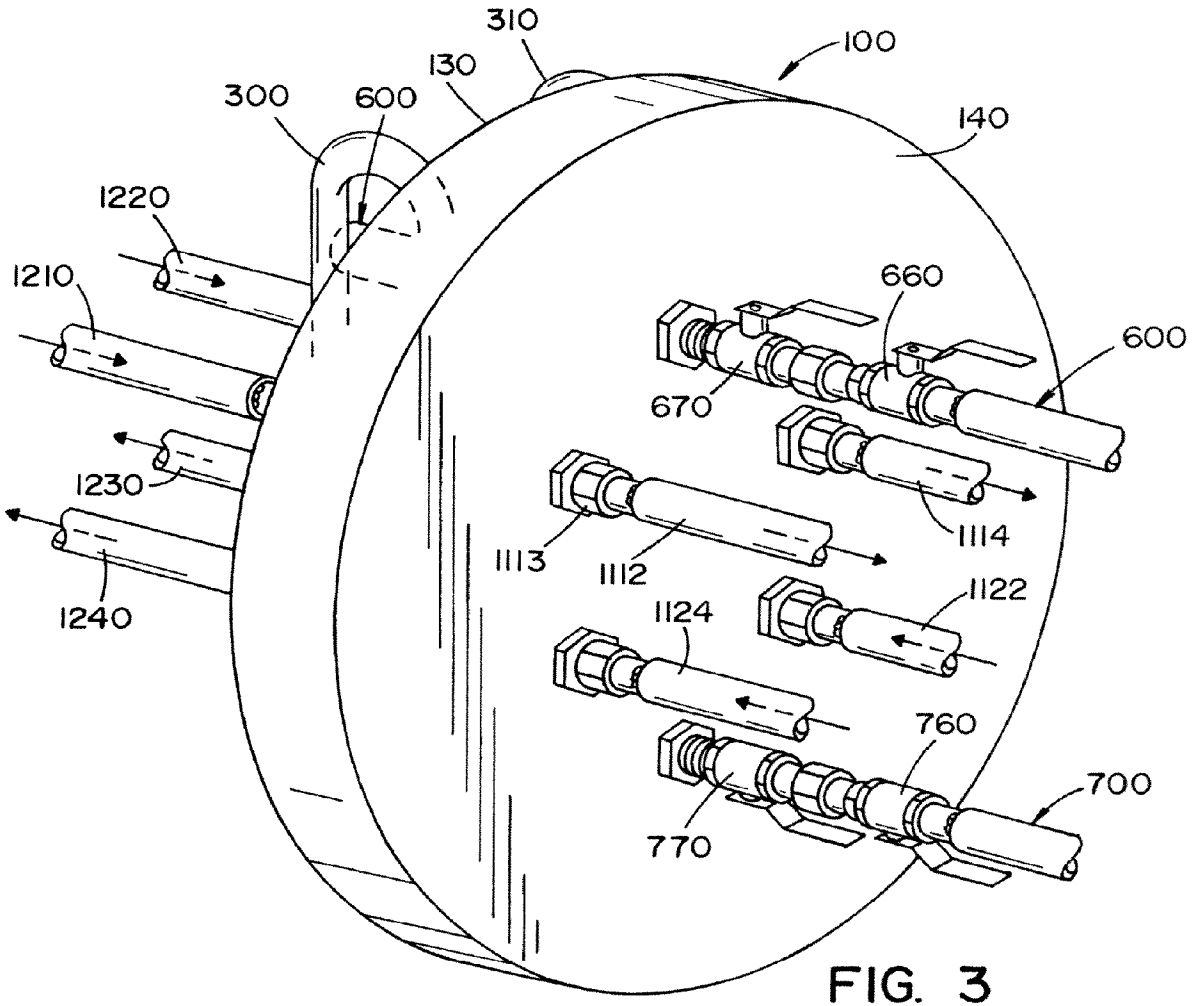
FIG. 3 illustrates the back face of a power port of a VIM induction furnace.

The back end 251, 261, 271, 281 of the mid portion 250, 260, 270, 280 of the JIC power connector is designed to be connected to power connectors 1112, 1114, 1122, 1124 on the two induction coils 1110, 1120 of induction heating system 1100 as illustrated in FIGS. 3, 4 and 6. FIG. 3 illustrates the back side 140 of the power port 100. The back ends include a threaded region that can be connected to a threaded coupler 1113 of power connector 1112; however, it can be appreciated that may other coupling arrangements can be used, (e.g., quick coupling arrangement, welded connection, etc.).

As previously stated, during normal operation of the VIM furnace, the external power source and cooling system 1200 supplies current and cooling fluid to the induction heating system 1100. The flow of cooling fluid during the operation of the VIM furnace is illustrated by the arrows in FIGS. 1, 4 and 6. The change out of the induction heating system 1100 from the vacuum chamber 1000 can be accomplished by rerouting the cooling fluid flow as illustrated in FIGS. 2, 5 and 7.

FIG. 7 illustrate the top 1002 of the vacuum chamber 1000 can be removed so that the induction heating system 1100 can be lifted from the vacuum chamber 1000 as indicated by the arrow and allowed to fully cool at a remote location while another induction heating system 1100 is inserted into the vacuum chamber. FIG. 7 illustrates the induction heating system 1100 disconnected from the external power source and cooling system 1200.

Figure 2:
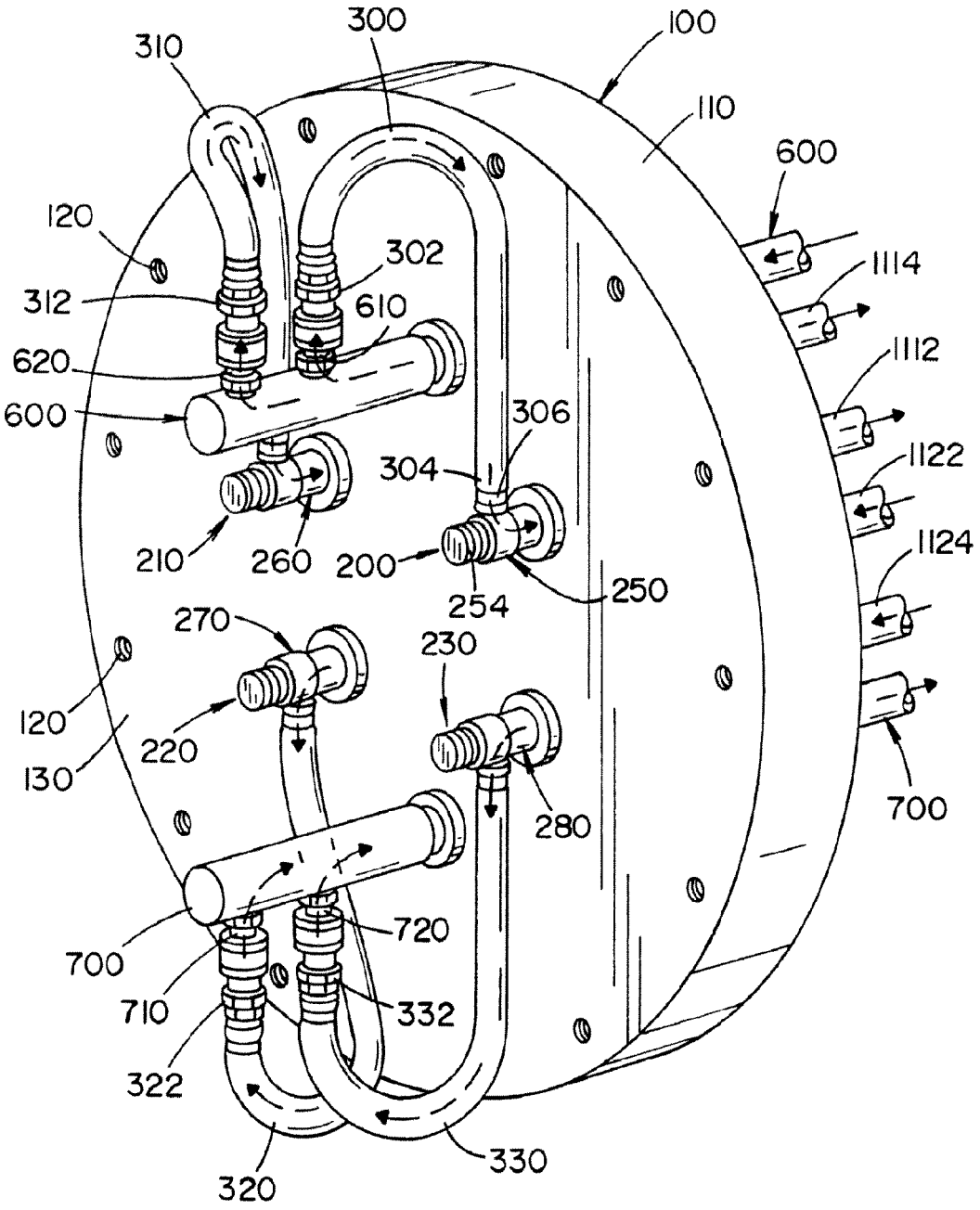
FIG. 2 illustrates a front face of a power port wherein the JIC fittings have been disconnected from the power source and the cooling fluid has been rerouted for removal of the induction furnace from the vacuum chamber.

As illustrated in FIGS. 2, 5 and 7, the front portion 202, 212, 222, 232 of the JIC power connectors 200, 210, 220, 230 are disconnected from the mid portion 250, 260, 270, 280 of the JIC power connectors. This is partially accomplished by disengaging the threaded coupler at the rear of the front portion of the JIC power connectors from the threaded front end of the mid portion the JIC power connectors. Also, the front end of fluid cables 300, 310, 320, 330 are disconnected from the front portion 202, 212, 222, 232 of the JIC power connectors 200, 210, 220, 230. The disconnection of the front portion of the JIC power connectors from the mid portion of the JIC power connectors and the front end of fluid cables from the front portion of the JIC power connectors results in the power port being fully disconnected from the external power source and cooling system 1200 as illustrated in FIG. 7. However, once such disconnection has occurred, cooling fluid needs to be again directed to the induction heating system 1100 so as to prevent damage to the induction heating system as the induction be system continues to cool FIGS. 2, 5 and 7 illustrate one non-limiting arrangement to direct auxiliary cooling fluid to the induction heating system when the induction heating system is disconnected from the external power source and cooling system 1200.

As illustrated in FIG. 2, fluid cables 300, 310 that were disconnected from the on portion 202, 212 of JIC power connectors 200, 210 are connected to cooling fluid pipe 600. Also, fluid cables 320, 330 that ere disconnected from the front portion 222, 232 of the JIC power connectors 220, 230 are connected to cooling fluid pipe 700. As illustrated in FIG. 7, cooling fluid pipe 600 supplies cooling fluid to the power port, which in turn directs the cooling fluid to the induction heating system 1100. Cooling fluid pipe 700 receives from the power port the cooling fluid that has passed through the induction heating system 1100.

As illustrated in FIG. 7, a coupling arrangement 650 is connected to the induction heating system 1100; however, this is not required. The coupling arrangement 650 is designed to be connectable at a first end 652 to an auxiliary cooling fluid source 800. The auxiliary cooling fluid source can be supplied by a flexible or rigid pipe or tubing. The type of connection arrangement is non-limiting. One type of connection arrangement is a quick disconnect arrangement. Flow valves can be included to prevent fluid flow from the auxiliary cooling fluid source 800 or out from the first end of the coupling arrangement 650 when the auxiliary cooling fluid source 800 is disconnected from the coupling arrangement 650; however, this is not required.

Figure 10:
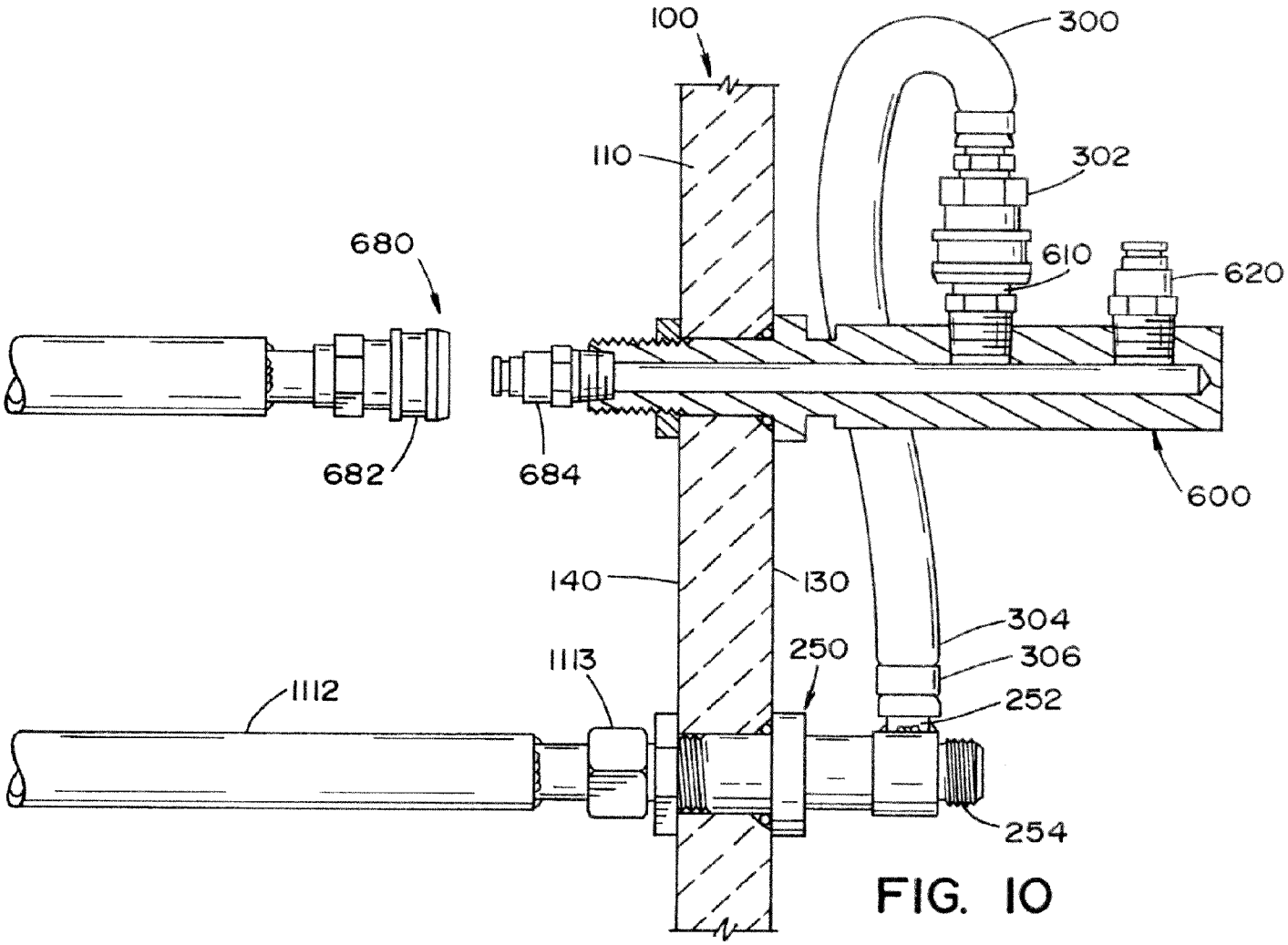
FIG. 10 is an alternative embodiment of the JIC fittings that includes a quick coupling arrangement; and, FIG. 11 is an alternative embodiment of the JIC fittings that includes a higher flow region for an end of the JIC fitting.

As illustrated in FIGS. 5 and 7, two valves 660, 670 can be optionally included on the cooling fluid pipe 600. The valves, when used, can be used to disconnect the rear portion of the cooling fluid pipe 600 from the front portion of the cooling fluid pipe 600. The type of valves used is non-limiting. As illustrated in FIG. 10, the two handle valves can be substituted for a single quick disconnect system 680. The quick disconnect system 680 can include two valves that prevent fluid flow when the two ends 682, 684 of the quick disconnect system are disconnected from one another; however, this is not required. As can be appreciated, only one of the two ends can include the valve.

As illustrated in FIGS. 2, 5 and 7, the front portion of the cooling fluid pipe 600 that extends outwardly from the front face of the power port includes two connectors 610, 620 that are designed to be connected to fluid cables 300, 310. The type of connector is generally the same as the quick coupling arrangement on front portion 202 of the JIC power connector 200; however, this is not required. The quick coupling arrangement can include a flow valve that prevents fluid flow through the quick coupling arrangement when the fluid cable is not connected to the quick coupling arrangement; however, this is not required.

As illustrated in FIGS. 2 and 7, the cooling fluid pipe 700 has a similar arrangement as cooling fluid pipe 600; however, this is not required. As illustrated in FIG. 7, a coupling arrangement 750 is connected to the induction heating system 1100; however, this is not required. The coupling arrangement 750 is designed to be connectable at a first end 752 to an auxiliary cooling fluid return 810. The type of connection arrangement is non-limiting. One type of connection arrangement is a quick disconnect arrangement. Flow valves can be included to prevent fluid flow from the auxiliary cooling fluid source 810 or out from the first end of the coupling arrangement 750 when the auxiliary cooling fluid return 810 is disconnected from the coupling arrangement 752; however, this is not required.

As illustrated in FIGS. 5 and 7, two valves 760, 770 can be optionally included on the cooling fluid pipe 700. The valves, when used, can be used to disconnect the rear portion of the cooling fluid pipe 700 from the front portion of the cooling fluid pipe 700. The type of valves used is non-limiting. The two handle valves can be substituted for a single quick disconnect system similar to the system illustrated in FIG. 10; however, this is not required.

As illustrated in FIGS. 2 and 7, the front portion of the cooling fluid pipe 700 that extends outwardly from the front face of the power port includes two connectors 710, 720 that are designed to be connected to fluid cables 320, 330. The type of connector is generally the same as the quick coupling arrangement on front portion 202 of the JIC power connector 200; however, this is not required. The quick coupling arrangement can include a flow valve that prevents fluid flow through the quick coupling arrangement when the fluid cable is not connected to the quick coupling arrangement; however, this is not required.

As illustrated in FIG. 7, once the fluid cables are connected to cooling fluid pipe 600, 700, cooling fluid can flow into induction heating system 1100 and cool the induction heating system during and after the induction heating system is removed from the vacuum chamber. When another induction heating system 1100 is inserted into the vacuum chamber, the induction heating system can be simply connected to the external power source and cooling system 1200.

Figure 8:
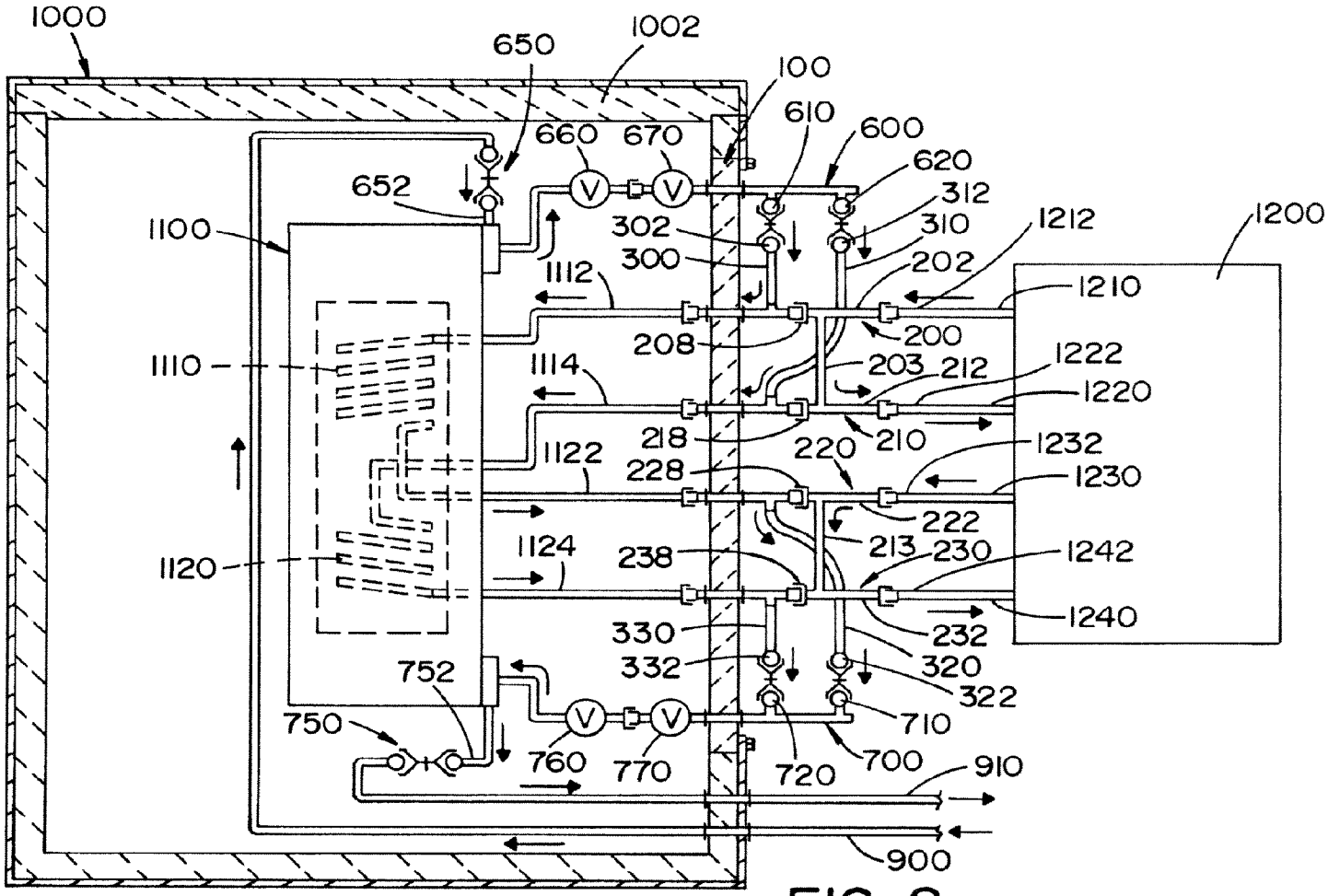
FIG. 8 is an alternative schematic view of the power and cooling connections illustrating cooling fluid flowing through the power leads during the standard operation of the VIM induction furnace.
Figure 9:
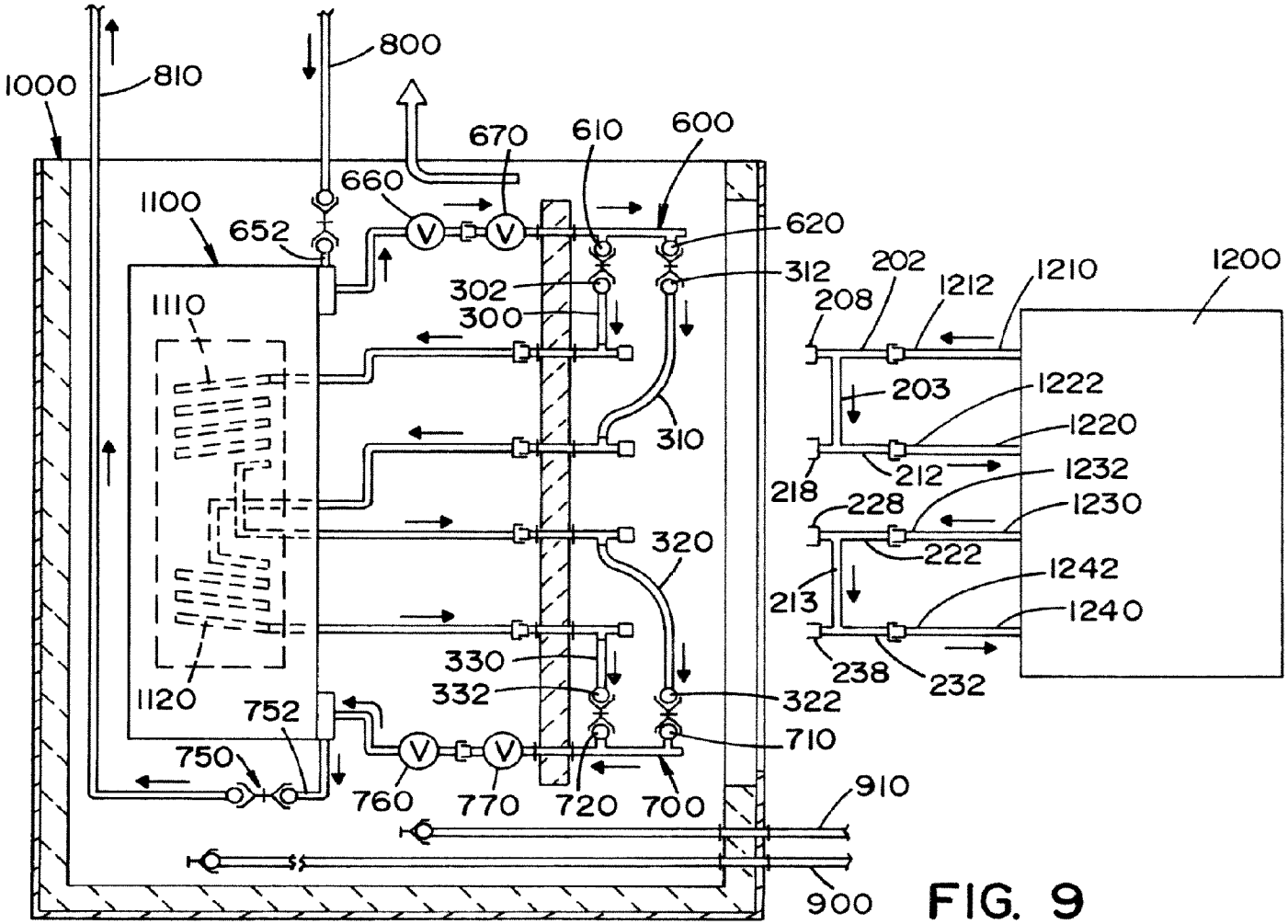
FIG. 9 is a schematic view of the power and cooling connections of FIG. 8 illustrating the power leads disconnected from the power source and the cooling fluid being connected to an auxiliary source for removal of the induction furnace from the vacuum chamber.

Referring now to FIGS. 8 and 9, another non-limiting embodiment of the invention is illustrated. The difference between the two embodiment is that the cooling fluid from the external power source and cooling system 1200 is not used to cool the induction heating system 1100. As illustrated in FIG. 8, the cooling fluid from the external power source and cooling system 1200 only is used to cool the power leads 1210, 1220, 1230, 1240 and the front portion 202, 212, 222, 232 of the JIC power connectors 200, 210, 220, 230. A connection pipe 203 is used to direct fluid from the back end of front portion 202 to the back end of front portion 222. Likewise, connection pipe 213 is used to direct fluid from the back end of front portion 212 to the back end of front portion 232. A fluid baffle can optionally be used to ensure proper cooling fluid flow to the back end of the front portions of the JIC power connectors; however, this is not required.

As illustrated in FIG. 8, the cooling fluid to the induction heating system 1100 is supplied by cooling fluid lines 900, 910. Cooling fluid line 900 supplies cooling fluid to cooling fluid pipe 600, and cooling fluid line 910 receives cooling fluid from cooling fluid pipe 700. The configuration of cooling fluid pipes 600, 700 can be the same as or similar to cooling fluid pipes 600, 700 illustrated in FIGS. 1-7 and 10; however, this is not required. The fluid connection between cooling fluid lines 900, 910 and cooling fluid pipes 600, 700 can be the same as or similar as illustrated in FIGS. 1-7 and 10; however, this is not required.

As illustrated in FIG. 8, the front portion of the cooling fluid pipe 600 that extends outwardly from the front face of the power port includes two connectors 610, 620 that are designed to be connected to fluid cables 300, 310. The type of connector is generally a quick coupling arrangement; however, this is not required. The quick coupling arrangement can include a flow valve that prevents fluid flow through the quick coupling arrangement when the fluid cable is not connected to the quick coupling arrangement; however, this is not required.

As illustrated in FIG. 8, the cooling fluid pipe 700 has a similar arrangement as cooling fluid pipe 600; however, this is not required. As illustrated in FIG. 8, a coupling arrangement 750 is connected to the induction heating system 1100; however, this is not required. The coupling arrangement 750 is designed to be connectable at a first end 752 to cooling fluid return line 910. The type of connection arrangement is non-limiting. One type of connection arrangement is a quick disconnect arrangement. Flow valves can be included to prevent fluid flow from the cooling fluid source 910 or out from the first end of the coupling arrangement 750 when the cooling fluid return line 910 is disconnected from the coupling arrangement 752; however, this is not required.

As illustrated in FIG. 8, two valves 760, 770 can be optionally included on the cooling fluid pipe 700. The valves, when used, can be used to disconnect the rear portion of the cooling fluid pipe 700 from the front portion of the cooling fluid pipe 700. The type of valves used is non-limiting.

As illustrated in FIG. 8, the front portion of the cooling fluid pipe 700 that extends outwardly from the front face of the power port includes two connectors 710, 720 that are designed to be connected to fluid cables 320, 330. The type of connector is generally a quick coupling arrangement; however, this is not required. The quick coupling arrangement can include a flow valve that prevents fluid flow through the quick coupling arrangement when the fluid cable is not connected to the quick coupling arrangement; however, this is not required.

As illustrated in FIG. 8, once the fluid cables are connected to cooling fluid pipe 600, 700, cooling fluid can flow into induction heating system 1100 and cool the induction heating system.

Referring now to FIG. 9, the induction heating system 1100 can be removed from the vacuum chamber 1000 by 1) simply disconnecting the back end of the front portion front portion 202, 212, 222, 232 of the JIC power connectors 200, 210, 220, 230 from the mid portion 250, 260, 270, 280 of the JIC power connectors, 2) disconnecting cooling fluid lines 900, 910 from cooling fluid pipes 600, 700, and 3) connecting auxiliary cooling fluid source 800 and auxiliary cooling fluid return 810 to cooling fluid lines 900, 910. The back end of the front portion front portion of the JIC power connectors can be simply disconnected from the mid portion JIC power connectors by unthreading the threaded coupler 208, 218, 228, 238 on the back end of the front portion of the JIC power connector from the front end of the mid portion of the JIC power connectors. The disconnecting and connecting of a cooling fluid source to cooling fluid pipes 600, 700 can be the same or similar to the process described in FIGS. 6 and 7. The vacuum chamber 1000 can be removed so that the induction heating system 1100 can be lifted from the vacuum chamber 1000 as indicated by the arrow in FIG. 9 and allow the induction heating system 1100 to fully cool at a remote location while another induction heating system 1100 is inserted into the vacuum chamber.

The present invention is directed to a product, method and process that allows an induction furnace to be removed while hot so that a spare furnace can be installed immediately without the cool-down time. Many VIM furnaces are cooled from an external source outside of the vacuum chamber through the power leads. These power leads pass through a power port located on the vacuum chamber. Special JIC fittings on the power leads are the actual electrical and cooling water interface. Breaking the JIC power lead connection breaks both the cooling water and electrical connection. The product, method and process of the present invention allows the water to be diverted around the JIC power connection of the power leads making it an electrical (dry) connection.

As described above, there are at least two ways different arrangements that can be used to divert the water around the JIC power connection of the power leads so as to make the JIC power connection an electrical (dry) connection. As can be appreciated, other arrangement may exist to divert the water around the JIC power connection of the power leads so as to make the JIC power connection an electrical (dry) connection, and such other arrangements fall within the scope of the present invention.

In one specific non-limiting configuration of the invention, the induction furnace is cooled through the power leads during operation. The cooling water goes through the external power leads and is diverted around the JIC fitting through the power port and into the induction furnace. Half of the leads are inlet water and half are return water. When the furnace has to be changed, the vacuum chamber is opened. The water feed and return lines are lowered into the chamber and attached to the manifold on the furnace body and the water turned on. Once the water is turned on, the body manifolds and the power port manifolds are active. The hoses that divert the water around the JIC dry power connections are disconnected from the external water and connected one at a time to the manifold on the power port. The only time water is not flowing through the induction coil is when a path is disconnected from the external water and connected to the power port manifold. This is only a few seconds and will do no harm to the coil. The JIC fittings can now be disconnected. The power port is unbolted from the inside of the vacuum chamber flange and hung onto the induction furnace. The induction furnace can now be removed to a location in the shop where it can continue cooling down. A new induction furnace can then be installed into the vacuum chamber.

In another specific non-limiting configuration of the invention, the induction furnace is cooled through two water paths through the vacuum chamber. The water is fed through the vacuum chamber wall to the inlet and outlet furnace body manifolds. The manifolds on the furnace body and the power port will be active throughout the entire heating cycles and the cool-down. The furnace side (male) of the JIC will be cooled with internal water through the power port manifolds. The external (female) side will be cooled from the external source through the leads. The external water only cools the leads and the female JIC fitting. The water is never diverted around the JIC fitting. When an induction furnace change is required, the vacuum chamber is opened. Water feed and return lines are lowered into the vacuum chamber. The vacuum chamber water lines are disconnected from the furnace body manifolds and the water lines lowered into the vacuum chamber are connected to the induction furnace body manifolds and the water is turned on. The only time the coil is not being cooled is when the water supply lines are being switched on the body manifolds. After the switch, the induction furnace is being cooled by the external water lines lowered into the vacuum chamber. The JIC power leads can then be disconnected. The power port is unbolted from the inside of the vacuum chamber flange and hung onto the induction furnace. The induction furnace can now be removed to a location in the shop where it can continue cooling down. A new induction furnace can be installed into the vacuum chamber. The advantage of the second method is that all of the individual hoses that divert the cooling water around the JIC fitting do not have to be connected/disconnected because the induction furnace cooling water is never supplied through the power port. This will make an induction furnace change quicker.

The product, method and process that allows an induction furnace to be removed while hot so that a spare furnace can be installed immediately without the cool-down time is made possible because of a special JIC fitting that allows the power to flow through it, but the cooling water does not flow through the fitting. In one non-limiting arrangement, the JIC fitting has a baffle inserted into the fitting that diverts some of the water to cool the internal surfaces at the end of the fitting. The end of the JIC fitting will heat the most because of the concentrated electric current flow. If the cooling water flow in the fitting end is stagnant or the water flow is insufficient, the cooling water inside the power leads will boil. Such boiling will further compound the problem because the boiling water will no longer make contact with the surfaces that will need to be cooled. Boiling in the fitting will also reduce the main water flow in the fitting. The design of the present invention is designed to overcome these potential problems during the change out of the induction furnace.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

We claim:

1. A method for removing an induction furnace from a vacuum chamber prior to fully cooling said induction furnace comprising the steps of:

a) providing a first induction furnace that is positioned in a vacuum chamber, said first induction furnace at a temperature that requires cooling fluid to flow through said first induction furnace to prevent damage to said first induction furnace, said vacuum chamber includes a removable power port, said power port including a plurality of JIC power connectors that are removably connected to power leads of said power source that is positioned external to said vacuum chamber, at least one of said JIC power connectors includes a fluid baffle that at least partially directs a flow of cooling fluid in said JIC power connector to reduce regions of said JIC power connector that are absent said flow of cooling fluid;

b) disconnecting said first induction furnace from a power source that is positioned external to said vacuum chamber;

c) connecting an auxiliary cooling fluid source to said first induction furnace; and, d) removing said first induction furnace from said vacuum chamber while said auxiliary cooling fluid source is supplying cooling fluid to said first induction furnace, said first induction furnace at said time said first induction furnace is required from said vacuum chamber being at temperature that requires cooling fluid to flow through said first induction furnace to prevent damage to said first induction furnace.

2. The method as defined in claim 1, including the step of inserting a second induction furnace into said vacuum chamber after said first induction furnace is removed from said vacuum chamber.

3. The method as defined in claim 1, wherein connectors of said auxiliary cooling fluid source are configured to move with said first induction furnace when said first induction furnace is removed from said vacuum chamber.

4. The method as defined in claim 3, wherein first and second JIC power connectors are configured to receive cooling fluid from first and second power leads and supply cooling fluid to said first induction furnace, third and fourth JIC power connectors are configured to direct cooling fluid back through third and fourth power leads, said steps of disconnecting and connecting including a) fluidly connecting together said first and second JIC power connectors, b) disconnecting said first and second JIC power connectors from said first and second power leads, c) connecting one of said first and second JIC power connectors to said auxiliary cooling fluid source, d) fluidly connecting together said third and fourth JIC power connectors, e) disconnecting said third and fourth JIC power connectors from said third and fourth power leads, f) connecting one of said third and fourth JIC power connectors to said auxiliary cooling fluid source.

5. The method as defined in claim 3, wherein said JIC power connectors are configured to not receive cooling fluid from said power leads, said steps of disconnecting and connecting including a) fluidly connecting together first and second JIC power connectors, b) disconnecting said first and second JIC power connectors from first and second power leads, c) connecting one of said first and second JIC power connectors to said auxiliary cooling fluid source, d) fluidly connecting together third and fourth JIC power connectors, e) disconnecting said third and fourth JIC power connectors from third and fourth power leads, f) connecting one of said third and fourth JIC power connectors to said auxiliary cooling fluid source, cooling fluid flow through said first, second, third and fourth power leads is uninterrupted during said steps of disconnecting and connecting.

6. An apparatus for removing an induction furnace from a vacuum chamber prior to fully cooling said induction furnace, said apparatus including a first induction furnace that is removably positioned in a vacuum chamber, said first induction furnace including a power port that is removably connected from said vacuum chamber, said power port including a plurality of connectors that connect the induction furnace to a primary cooling fluid source and a power source, said power source located externally of said vacuum chamber, said plurality of connectors configured to be disconnectable from said power source, said plurality of connectors configured to be disconnectable from said primary cooling source and connectable to an auxiliary cooling source to enable said first induction furnace to be removed from said vacuum chamber while said first induction furnace is at a temperature that requires cooling fluid to flow through said first induction furnace to prevent damage to said first induction furnace, said power port includes a plurality of JIC power connectors that are removably connected to power leads of said power source, at least one of said JIC power connectors includes a fluid baffle that at least partially directs a flow of cooling fluid in said JIC power connector to reduce regions of said JIC power connector that are absent said flow of cooling fluid.

7. The apparatus as defined in claim 6, wherein first and second JIC power connectors are configured to receive cooling fluid from first and second power leads and supply cooling fluid to said first induction furnace, third and fourth JIC power connectors are configured to direct cooling fluid back through third and fourth power leads, said first and second JIC power connectors configured to be fluidly connected together when disconnected from said first and second power leads, one of said first and second JIC power connectors configured to be connected to said auxiliary cooling fluid source when disconnected from said first and second power leads, said third and fourth JIC power connectors configured to be fluidly connected together when disconnected from said third and fourth power leads, one of said third and fourth JIC power connectors configured to be connected to said auxiliary cooling fluid source when disconnected from said third and fourth power leads.

8. The apparatus as defined in claim 6, wherein said cooling fluid does not flow between a plurality of said JIC power connectors and a plurality of power leads, first and second JIC power connectors configured to be fluidly connected together when disconnected from first and second power leads, one of said first and second JIC power connectors configured to be connected to said auxiliary cooling fluid source when disconnected from said first and second power leads, third and fourth JIC power connectors configured to be fluidly connected together when disconnected from third and fourth power leads, one of said third and fourth JIC power connectors configured to be connected to said auxiliary cooling fluid source when disconnected from said third and fourth power leads, cooling fluid flow through said power leads is uninterrupted during said steps of disconnecting and connecting JIC power connectors from said power leads.

9. A power port for an induction furnace, said power port configured to be removably connected to a vacuum chamber, said power port including a plurality of connectors that connect the induction furnace to a primary cooling fluid source and a power source, said power source located externally of said vacuum chamber, said plurality of connectors configured to be disconnectable from said power source, said plurality of connectors configured to be disconnectable from said primary cooling source and connectable to an auxiliary cooling source to enable said first induction furnace to be removed from said vacuum chamber while said first induction furnace is at a temperature that requires cooling fluid to flow through said first induction furnace to prevent damage to said first induction furnace, said power port includes a plurality of JIC power connectors that are removably connected to a plurality of power leads of said power source, said JIC power connector includes a fluid baffle that at least partially directs a flow of cooling fluid in said JIC power connector to reduce regions of said JIC power connector that are absent said flow of cooling fluid.

10. A method for removing an induction furnace from a vacuum chamber prior to fully cooling said induction furnace comprising the steps of:

a) providing a first induction furnace that is positioned in a vacuum chamber, said first induction furnace at a temperature that requires cooling fluid to flow through said first induction furnace to prevent damage to said first induction furnace, said vacuum chamber includes a removable power port, said power port includes a plurality of JIC power connectors that are removably connected to power leads of said power source that is positioned external to said vacuum chamber, at least one of said JIC power connectors includes a fluid baffle that at least partially directs a flow of cooling fluid in said JIC power connector to reduce regions of said JIC power connector that are absent said flow of cooling fluid;

b) disconnecting said first induction furnace from a power source that is positioned external to said vacuum chamber by disconnecting a plurality of power connectors on said power port and a plurality of power leads on said power source, said cooling fluid does not flow between said plurality of power connectors on said power port and said plurality of power leads on said power source, said step of disconnecting including i) first and second power connectors being fluidly connected together when disconnected from first and second power leads, ii) third and fourth power connectors being fluidly connected together when disconnected from third and fourth power leads;

c) connecting an auxiliary cooling fluid source to said first induction furnace, said step of connecting including i) one of said first and second power connectors being connected to said auxiliary cooling fluid source when disconnected from said first and second power leads, ii) one of said third and fourth power connectors being connected to said auxiliary cooling fluid source when disconnected from said third and fourth power leads, cooling fluid flow through said power leads is uninterrupted during said steps of disconnecting and connecting power connectors from said power leads; and, d) removing said first induction furnace from said vacuum chamber while said auxiliary cooling fluid source is supplying cooling fluid to said first induction furnace, said first induction furnace at said time said first induction furnace is required from said vacuum chamber being at temperature that requires cooling fluid to flow through said first induction furnace to prevent damage to said first induction furnace.

* * * * *